US008888560B2

(12) United States Patent
Min et al.

(10) Patent No.: US 8,888,560 B2
(45) Date of Patent: Nov. 18, 2014

(54) METHOD FOR UNIFORMLY POLISHING LARGE SCALE PLATE

(71) Applicant: LG Chem, Ltd., Seoul (KR)

(72) Inventors: Kyoung-Hoon Min, Daejeon (KR); Ye-Hoon Im, Daejeon (KR); Dae-Yeon Lee, Chungbuk (KR); Jae-Ik Song, Gyeonggi-do (KR); Su-Chan Park, Daejeon (KR)

(73) Assignee: LG Chem, Ltd., Seoul (KR)

( * ) Notice: Subject to any disclaimer, the term of this patent is extended or adjusted under 35 U.S.C. 154(b) by 0 days.

(21) Appl. No.: 13/753,147

(22) Filed: Jan. 29, 2013

(65) Prior Publication Data

US 2013/0149939 A1 Jun. 13, 2013

Related U.S. Application Data

(63) Continuation of application No. PCT/KR2011/005657, filed on Aug. 1, 2011.

(30) Foreign Application Priority Data

Aug. 2, 2010 (KR) ..... 10-2010-0074710

(51) Int. Cl.

| | |
|---|---|
| ***B24B 1/00*** | (2006.01) |
| ***B24B 7/00*** | (2006.01) |
| ***B24B 49/00*** | (2012.01) |
| ***B24B 37/005*** | (2012.01) |
| ***B24B 37/04*** | (2012.01) |

(52) U.S. Cl.

CPC . *B24B 7/00* (2013.01); *B24B 49/00* (2013.01); *B24B 37/005* (2013.01); *B24B 37/042* (2013.01)

USPC ..... 451/59; 451/41; 451/63

(58) Field of Classification Search

CPC ..... B24B 7/00; B24B 7/075; B24B 7/07; B24B 7/242; B24B 1/00; B24B 29/00; B24B 37/042

USPC ..... 451/41, 59, 63

See application file for complete search history.

(56) References Cited

U.S. PATENT DOCUMENTS

| | | | | |
|---|---|---|---|---|
| 1,865,284 | A * | 6/1932 | Smith | 269/48 |
| 3,026,653 | A * | 3/1962 | De Zordo | 451/160 |
| 4,833,832 | A * | 5/1989 | Lindsey et al. | 451/41 |
| 4,969,914 | A * | 11/1990 | Ikegaya et al. | 451/439 |

(Continued)

FOREIGN PATENT DOCUMENTS

| | | |
|---|---|---|
| JP | 09-253991 | 9/1997 |
| JP | 10-58317 | 3/1998 |

(Continued)

OTHER PUBLICATIONS

"A Study on CAD/CAM Pocket Processing Using the High Speed Machine" Yoo, et al.; Journal of the Korean Society of Manufacturing Process Engineers; vol. 3 No. 3, pp. 32-38 (Sep. 2004).

*Primary Examiner* — Timothy V Eley

(74) *Attorney, Agent, or Firm* — Mckenna Long & Aldridge LLP

(57) ABSTRACT

Disclosed is a substrate polishing method capable of minimizing a difference of polishing amounts between a center portion and a rim portion of a large scale plate during a plate polishing process.

3 Claims, 4 Drawing Sheets

(56) References Cited

U.S. PATENT DOCUMENTS

| | | | | |
|---|---|---|---|---|
| 7,011,569 | B2 | 3/2006 | Shimizu et al. | |
| 7,223,690 | B2 | 5/2007 | Kondo et al. | |
| 8,449,351 | B2 * | 5/2013 | Moon et al. | 451/41 |
| 2011/0223834 | A1 * | 9/2011 | Moon et al. | 451/5 |

FOREIGN PATENT DOCUMENTS

| | | |
|---|---|---|
| JP | 2004-515918 | 5/2004 |
| JP | 2009-214271 | 9/2009 |
| JP | 2010-064196 | 3/2010 |
| KR | 10-2007-0096878 | 10/2007 |

* cited by examiner

METHOD FOR UNIFORMLY POLISHING LARGE SCALE PLATE

CROSS-REFERENCE TO RELATED APPLICATION

The present application is a continuation of International Application No. PCT/KR2011/005657 filed Aug. 1, 2011, which claims priority to Korean Patent Application No. 10-2010-0074710 filed in the Republic of Korea on Aug. 2, 2010, the disclosures of which are incorporated herein by reference.

TECHNICAL FIELD

The present disclosure relates to a large scale plate and its polishing method, and more particularly, to a polishing method capable of minimizing a difference of polishing amounts between a center portion and a rim portion of a large scale plate during a plate polishing process, and a large scale plate produced by the method.

BACKGROUND ART

Generally, due to mechanical limits, a polishing machine is designed smaller than a large scale plate. In this case, in order to polish the entire surface of the large scale plate, the polishing machine moves while polishing the substrate.

Referring to FIG. 1, a travel range P1 by which an upper plate 1 of a general polishing machine moves in the longitudinal direction (x direction) of a substrate 2 is 60% to 80% of the radius of the upper plate 1, and a travel range P2 by which the upper plate 1 moves in the transverse direction (y direction) of the substrate 2 is 50% to 70% of the radius of the upper plate 1. In FIG. 1, a rectangle depicted with dots represents a path along which the center of the upper plate 1 moves during a polishing process.

If the upper plate 1 polishes the large scale plate 2 while moving as much as the travel ranges P1 and P2, the center portion of the large scale plate 2 is more polished, but the rim portion of the large scale plate 2 is less polished, which cause a serious polishing deviation. FIG. 2 shows the polishing deviation, in which a portion with a more polishing amount is depicted in red and a portion with a less polishing amount is depicted in blue.

The polishing deviation is generated since, when the upper plate 1 moves along the path 10, the upper plate 1 always passes over the entire center portion but passes over a part of the rim portion which corresponds to just ¼ of the center portion.

Meanwhile, the polishing amount of a polishing pad is influenced by the wear condition of the polishing pad and the pressure applied to the substrate 2 by the polishing pad. Therefore, in order to decrease the polishing deviation, the wear condition of the polishing pad and the pressure applied to the substrate 2 by the polishing pad should be considered together.

DISCLOSURE

Technical Problem

The present disclosure is designed to solve the problems of the prior art, and therefore it is an object of the present disclosure to provide a polishing method capable of minimizing a difference of polishing amounts (or, a polishing deviation) between a center portion and a rim portion of a large scale plate while the large scale plate is polished.

In particular, an object of the present disclosure is to provide a polishing method capable of minimizing a difference of polishing amounts (a polishing deviation) by considering the wear condition of a polishing pad and the pressure applied to a substrate by the polishing pad together.

Another object of the present disclosure is to provide a large scale plate produced by the polishing method.

Technical Solution

In order to accomplish the above object, the present disclosure provides a method for polishing a substrate, wherein an upper plate performs a polishing process along a quadrangular path, and wherein a distance S1 by which the upper plate moves in the longitudinal direction of a substrate and a distance S2 by which the upper plate moves in the transverse direction of the substrate are 90% to 100% of a diameter D of the polishing pad installed to the upper plate.

Preferably, the path forms a rectangle.

More preferably, the path forms a square.

Preferably, S1 and S2 have a smallest value among values calculated by Equations 1 and 2 below:

$$D - d \qquad \text{Equation 1}$$

$$D' + \frac{D - D'}{2 - \left(\frac{P_{end}}{P_{eff}}\right)} \qquad \text{Equation 2}$$

where d: the sum of radial lengths of worn portions in a rim portion of the polishing pad;

D': diameter of a portion where the pressure applied to the substrate by the polishing pad is equal to or greater than an effective pressure ($P_{eff}$) which is suitable for wearing the substrate;

$P_{end}$: pressure applied to the substrate by the polishing pad at an outermost point in portions of the polishing pad other than the worn portions; and $P_{eff}$: pressure applied to the substrate by the polishing pad, suitable for wearing the substrate.

In addition, the present disclosure also provides a large scale plate uniformly polished by the polishing method.

DESCRIPTION OF DRAWINGS

Other objects and aspects of the present disclosure will become apparent from the following descriptions of the embodiments with reference to the accompanying drawings in which.

REFERENCE SYMBOLS

1: upper plate
2: substrate
3: polishing pad
S1: travel range of the upper plate in the longitudinal direction (x direction)
S2: travel range of the upper plate in the transverse direction (y direction)
a: length of the substrate in the longitudinal direction (x direction)
b: length of the substrate in the transverse direction (y direction)
D: diameter of the polishing pad
$P_{eff}$: effective pressure
D': diameter of a portion where the pressure applied to the substrate by the polishing pad is equal to or greater than the effective pressure $P_{eff}$
$D_{eff}$: effective polishing diameter

BEST MODE

Hereinafter, preferred embodiments of the present disclosure will be described in detail with reference to the accompanying drawings. Prior to the description, it should be understood that the terms used in the specification and the appended claims should not be construed as limited to general and dictionary meanings, but interpreted based on the meanings and concepts corresponding to technical aspects of the present disclosure on the basis of the principle that the inventor is allowed to define terms appropriately for the best explanation. Therefore, the description proposed herein is just a preferable example for the purpose of illustrations only, not intended to limit the scope of the disclosure, so it should be understood that other equivalents and modifications could be made thereto without departing from the spirit and scope of the disclosure.

Figure 3:
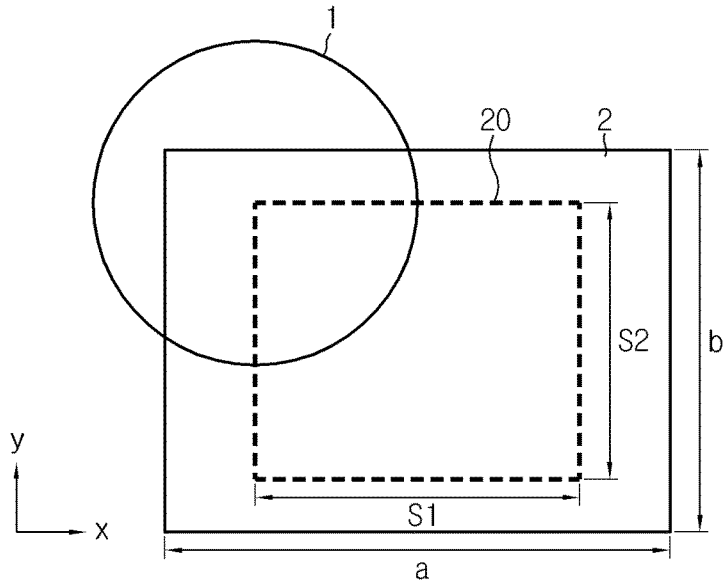
FIG. 3 is a diagram showing a path along which the center of an upper plate of a polishing machine moves during a polishing method according to a preferred embodiment of the present disclosure.
Figure 4:
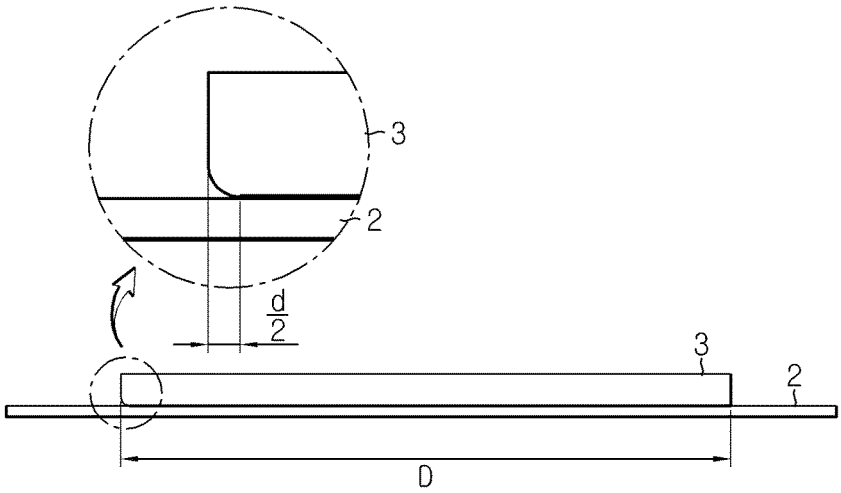
FIG. 4 is a cross-sectional view showing a contact state between a polishing pad and a substrate.

FIG. 3 is a diagram showing a path along which the center of an upper plate of a polishing machine moves during a polishing method according to a preferred embodiment of the present disclosure, and FIG. 4 is a cross-sectional view showing a contact state between a polishing pad and a substrate.

In the polishing method according to the present disclosure, a travel range S1 by which an upper plate 1 having a polishing pad 3 installed thereto moves in the longitudinal direction (x direction) of a substrate 2 and a travel range S2 by which the upper plate 1 moves in the transverse direction (y direction) are 90% to 100% of a diameter D of a polishing pad 3. The rectangle depicted by dots in the figures represents a path 201 along which the upper plate 1 moves during the polishing process. The path 201 is preferably a rectangle, more preferably a square. If the path 201 is a square, namely if S1 is equal to S2, the polishing deviation is smallest.

If S1 and S2 are smaller than 90% of D, during the polishing process, the upper plate 1 moves over the center portion of the large scale plate 2 while overlapping (superposing) its path. Therefore, a polishing amount at the center portion is much greater than that of the rim portion, which increases a polishing deviation.

If S1 and S2 are greater than 100% of D, during the polishing process, the upper plate 1 may not pass over the center portion of the large scale plate 2.

Meanwhile, if the polishing pad 31 installed to the upper plate 1 polishes the substrate 2, the polishing pad 31 starts to wear, especially from its rim portion. As shown in FIG. 4, in a state where the polishing pad 31 contacts the substrate 2, the worn rim portion (d/2) is not able to contact the substrate 2 and thus does not contribute to polishing of the substrate 2. Reference symbol d of FIG. 4 represents the sum of radial lengths of the worn rim portion. In FIG. 4, the upper plate 1 provided at the upper surface of the polishing pad 31 is not depicted.

Figure 5:
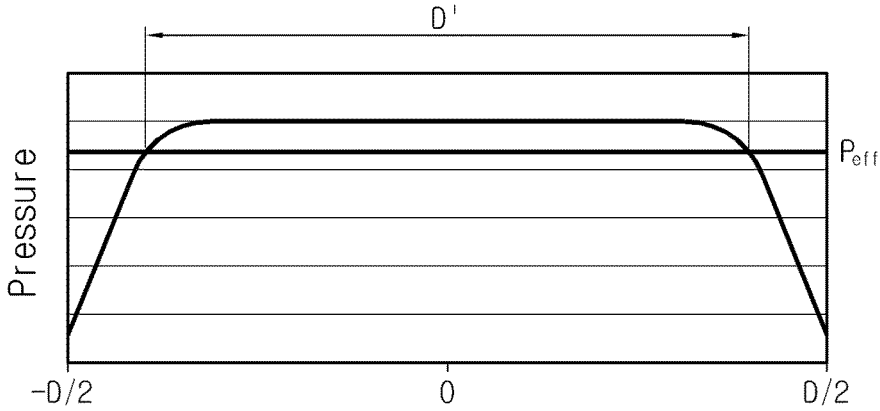
FIG. 5 is a graph showing the pressure applied to the substrate by the polishing pad in the state of FIG. 4.

In order to allow the polishing pad 31 to polish the substrate 2, the polishing pad 31 must apply a predetermined pressure (hereinafter, referred to as an 'effective pressure $P_{eff}$') to the substrate 2. Assuming that a diameter of a portion where the pressure applied to the substrate 2 by the polishing pad 31 is equal to or greater than the effective pressure $P_{eff}$ in order to ensure polishing of the substrate 2 is D', a diameter effective for the polishing (hereinafter, referred to as an 'effective polishing diameter $D_{eff}$') may be defined as a smaller value between D-d and D'. FIG. 5 exemplarily shows a relation of actual diameters D and D' of the polishing pad 3.

If the effective polishing diameter $D_{eff}$ is greater than the length (a) of the substrate 2 in the longitudinal direction (x direction) and the length (b) in the transverse direction (y direction) length, the substrate 2 may be polished without moving the upper plate 1. However, if the effective polishing diameter ($D_{eff}$) is smaller than (a) and (b), the upper plate 1 should be moved while polishing. In this case, the travel range S1 of the upper plate 1 in the longitudinal direction (x direction) and the travel range S2 in the transverse direction (y direction) preferably have a smaller value among values calculated by Equations 1 and 2 below.

$$D - d \qquad \text{Equation 1}$$

$$D' + \frac{D - D'}{2 - \left(\frac{P_{end}}{P_{eff}}\right)} \qquad \text{Equation 2}$$

In Equation 2, $P_{end}$ represents a pressure applied to the substrate by the polishing pad at an outermost point in portions of the polishing pad other than the worn portions.

Figure 1:
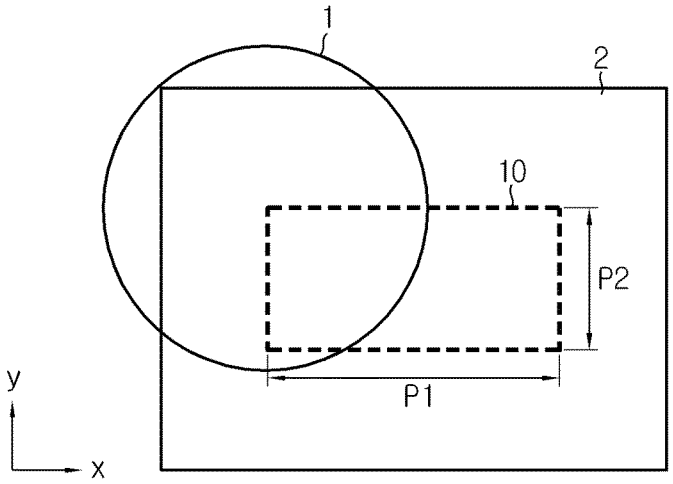
FIG. 1 is a diagram showing a path along which the center of an upper plate of a polishing machine moves when a large scale plate is polished according to the prior art.
Figure 2:
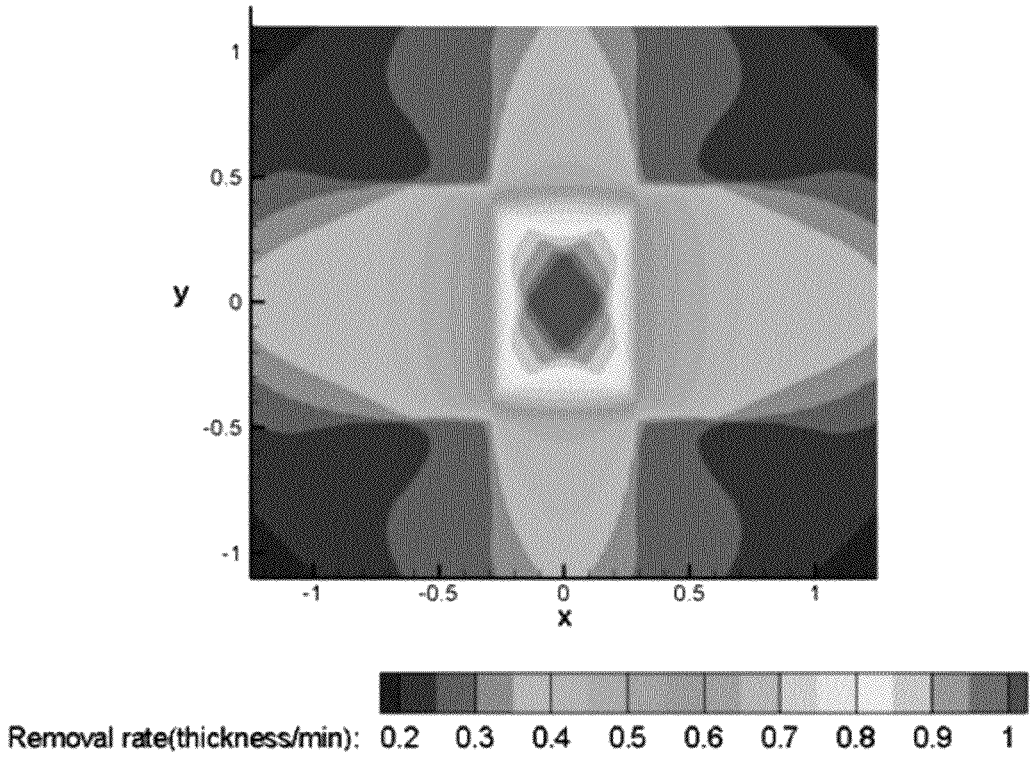
FIG. 2 is a diagram showing a polishing deviation generated during the polishing of FIG. 1.
Figure 6:
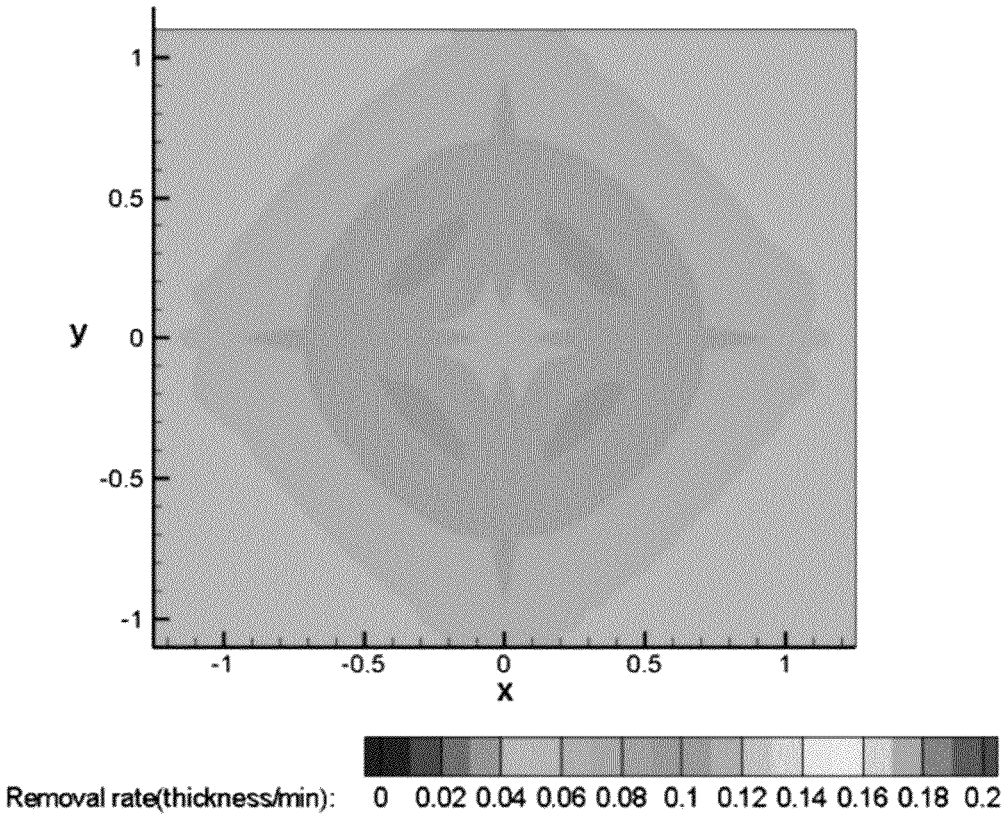
FIG. 6 is a diagram showing a polishing deviation generated during the polishing of FIG. 3.

If Equations 1 and 2 are used, since S1 and S2 may be determined by considering the worn state of the polishing pad 31 and the pressure applied to the substrate 2 by the polishing pad 31 together, the large scale plate 2 may be polished more uniformly. FIG. 6 shows polishing amounts when the travel ranges S1 and S2 are determined by using Equations 1 and 2. Comparing FIG. 6 with FIG. 2, it may be understood that the polishing deviation of FIG. 6 is much smaller than that of FIG. 2.

INDUSTRIAL APPLICABILITY

The substrate polishing method according to the present disclosure may minimize a difference of polishing amounts between a center portion and a rim portion of a large scale plate.

In particular, since the substrate polishing method according to the present disclosure considers the wear condition of the polishing pad and the pressure applied to the substrate by the polishing pad together when minimizing a difference of polishing amounts (polishing deviation), the large scale plate may be polished more uniformly.

Moreover, the present disclosure provides a large scale plate uniformly polished by the polishing method.

The present disclosure has been described in detail. However, it should be understood that the detailed description and specific examples, while indicating preferred embodiments of the disclosure, are given by way of illustration only, since various changes and modifications within the spirit and scope of the disclosure will become apparent to those skilled in the art from this detailed description.

What is claimed is:

1. A method for polishing a substrate by moving an upper plate having a polishing pad installed thereto, wherein the upper plate performs a polishing process on an upper portion of the substrate with respect to a surface portion of the substrate along a quadrangular path, wherein a travel range (S1) by which the upper plate moves in the longitudinal direction of the substrate and a travel range (S2) by which the upper plate moves in the transverse direction of the substrate are respectively 90% to 100% of a diameter (D) of the polishing pad installed to the upper plate; and wherein S1 and S2 have a smallest value among values calculated by Formulas 1 and 2 below:

$$D - d \qquad \text{[Formula 1]}$$

-continued $$D' + \frac{D - D'}{2 - \left(\frac{P_{end}}{P_{eff}}\right)} \qquad \text{[Formula 2]}$$

where d: double a radial length of a rim portion of the polishing pad, which does not contact the substrate;

D': diameter of a portion of the polishing pad where the pressure applied to the substrate by the polishing pad is equal to or greater than an effective pressure ($P_{eff}$) which is capable of wearing the surface portion of the substrate;

$P_{end}$: pressure applied to the substrate by the polishing pad at each outermost point in all portions of the polishing pad other than worn portions which do not contact the substrate; and $P_{eff}$: pressure applied to the substrate by the polishing pad, which is capable of wearing the surface portion of the substrate.

2. The method for polishing a substrate according to claim 1, wherein the path forms a rectangle.

3. The method for polishing a substrate according to claim 1, wherein the path forms a square.

* * * * *